US011813881B2

(12) United States Patent
Shimizu

(10) Patent No.: US 11,813,881 B2
(45) Date of Patent: Nov. 14, 2023

(54) PRINTING DEVICE, SPACER, AND ADJUSTMENT METHOD

(71) Applicant: CASIO COMPUTER CO., LTD., Tokyo (JP)

(72) Inventor: Daisuke Shimizu, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 309 days.

(21) Appl. No.: 17/198,942

(22) Filed: Mar. 11, 2021

(65) Prior Publication Data

US 2021/0282529 A1 Sep. 16, 2021

(30) Foreign Application Priority Data

Mar. 13, 2020 (JP) ..... 2020-043572

(51) Int. Cl.
*B41J 3/407* (2006.01)
*A45D 29/00* (2006.01)

(52) U.S. Cl.
CPC ..... *B41J 3/40731* (2020.08); *B41J 3/4073* (2013.01); *A45D 2029/005* (2013.01)

(58) Field of Classification Search
CPC ..... B41J 3/407
See application file for complete search history.

(56) References Cited

U.S. PATENT DOCUMENTS

2017/0367459 A1* 12/2017 Yamasaki ..... A45D 34/04

FOREIGN PATENT DOCUMENTS

| | | | | |
|---|---|---|---|---|
| CN | 107549980 | A | | 1/2018 |
| JP | 2003-534083 | A | | 11/2003 |
| JP | 2018-000401 | A | | 1/2018 |
| JP | 2019-17991 | A | | 2/2019 |
| KR | 20110016711 | A | * | 2/2011 |
| WO | 01/91598 | A1 | | 12/2001 |

OTHER PUBLICATIONS

Jang, MachineTranslationofKR-20110016711-A, 2011 (Year: 2011).*
CNIPA; Application No. 202110256025.8; Notification of First Office Action dated May 19, 2022.
JPO; Application No. 2020-043572; Notice of Reasons for Refusal dated Apr. 5, 2022.

* cited by examiner

*Primary Examiner* — Scott A Richmond
(74) *Attorney, Agent, or Firm* — Fitch, Even, Tabin & Flannery LLP

(57) ABSTRACT

Disclosed is a printing device including: a print head; a finger holder that includes a nail rest on which a nail is placed, and a spring which biases the nail rest in a direction of pushing up the nail rest to locate a printing target surface of the nail placed on the nail rest at a printing position by the print head; and a spacer that presses down the nail rest against a biasing force of the spring.

6 Claims, 5 Drawing Sheets

PRINTING DEVICE, SPACER, AND ADJUSTMENT METHOD

CROSS-REFERENCE TO RELATED APPLICATION

This application is based upon and claims the benefit of priority from the prior Japanese Patent Application No. 2020-043572, filed on Mar. 13, 2020, the entire contents of which are incorporated herein by reference.

BACKGROUND OF THE INVENTION

1. Field of the Invention

The present disclosure relates to a printing device, a spacer, and an adjustment method.

2. Description of the Related Art

There has been conventionally known a printing device (nail print device) that performs printing of a nail design on a nail or the like (for example, see JP 2003-534083 A).

In such a printing device, a nail is set at a predetermined position and a nail design selected by a user or the like is printed on the nail.

Such a device enables applying a nail design to nails without using a nail salon or the like.

When printing is performed with the printing device, it is preferable to have a constant distance between the print head and the nail surface which is the printing target. Thus, it is necessary to perform adjustment such that the nail surface is positioned at a position appropriate for the printing.

However, when printing is performed onto a gel nail which was already applied to the nail surface, a fake nail, or the like, the printing target surface is higher than the actual nail surface in some cases.

When the position of the printing target surface is higher than the actual nail height, setting the nail at the same position as the position of a nail of a normal height causes the possibility that the print head may contact the printing target surface.

SUMMARY OF THE INVENTION

According to an aspect of the present invention, there is provided a printing device including: a print head; a finger holder that includes a nail rest on which a nail is placed, and a spring which biases the nail rest in a direction of pushing up the nail rest to locate a printing target surface of the nail placed on the nail rest at a printing position by the print head; and a spacer that presses down the nail rest against a biasing force of the spring.

BRIEF DESCRIPTION OF THE DRAWINGS

The accompanying drawings are not intended as a definition of the limits of the invention but illustrate embodiments of the invention, and together with the general description given above and the detailed description of the embodiments given below, serve to explain the principles of the invention, wherein.

DETAILED DESCRIPTION OF THE PREFERRED EMBODIMENTS

An embodiment of a printing device according to the present invention will be described.

The embodiment described below is provided with various limitations technically preferable for carrying out the present invention. However, the scope of the present invention is not limited to the embodiment below or illustrated examples.

The following embodiment is described by taking, as an example, a case where the printing device is a nail print device that prints a fingernail(s) as a printing target. However, the printing target of the printing device in the present invention is not limited to the fingernail, and the printing target may be a nail of a toe, for example. The printing target may also be anything similar to nails other than nails of a person, such as nail tips, surfaces of various types of accessories, and the like.

Figure 1:
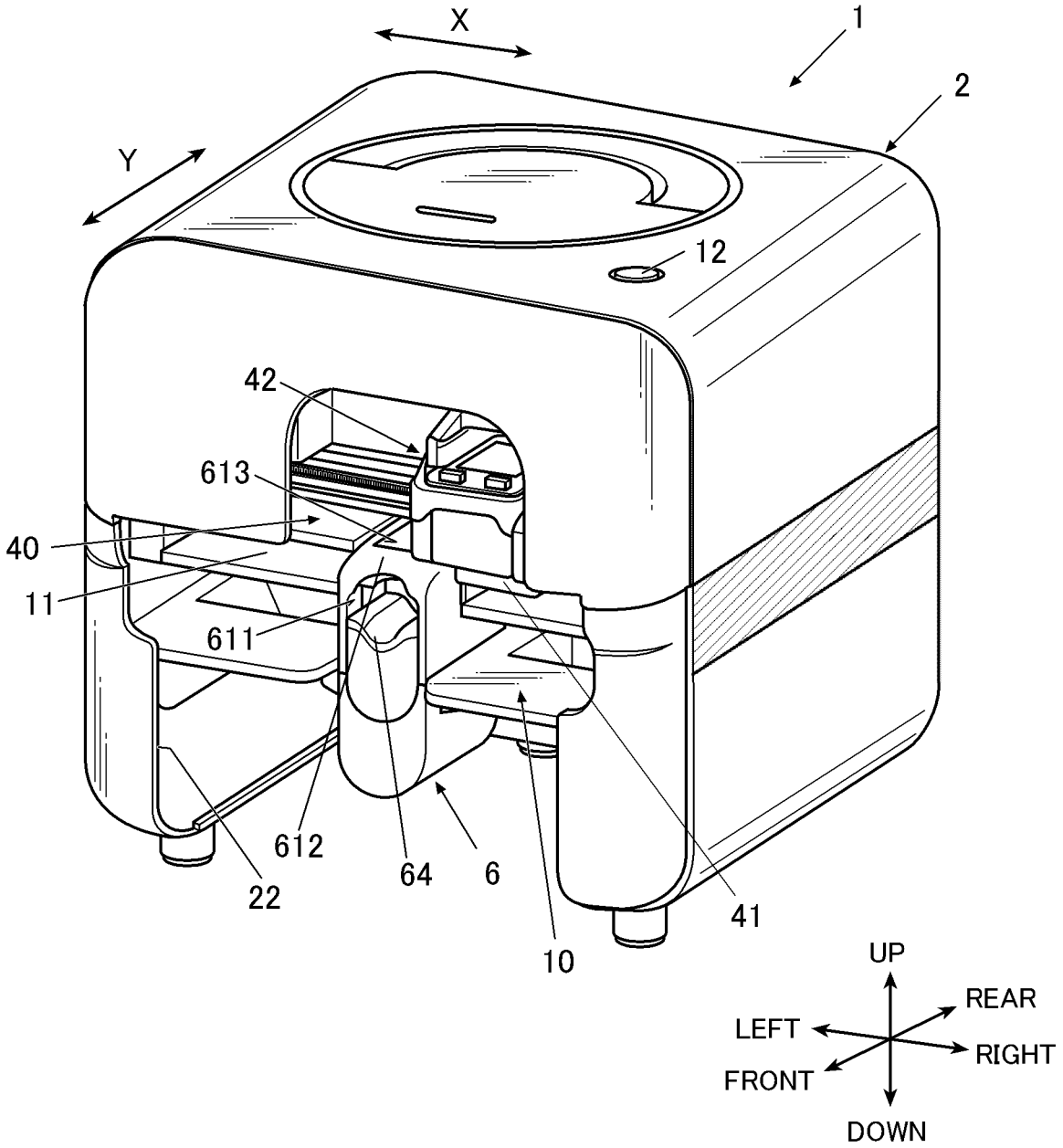
FIG. 1 is a perspective view showing the main part configuration of a printing device in the present embodiment.

FIG. 1 is a view showing the main part configuration of the printing device in the present embodiment.

In the following embodiment, the directions of up, down, left, right, front and rear are the directions shown in FIG. 1. The X direction and the Y direction are the directions shown in FIG. 1.

The printing device 1 in the present embodiment is a nail print device that applies printing to a nail T of a finger.

As shown in FIG. 1, the printing device 1 has a housing 2 that is formed in a nearly box shape and has an opening 22 on the front surface side of the device, for example.

An operating portion 12 of the printing device 1 is provided on the upper surface (top plate) of the housing 2. The operating portion 12 is an operation button (power switch button) to turn on/off the power of the printing device 1, for example. When the operating portion 12 is operated, the operation signal is output to a control device not shown in the drawings, and the control device performs control according to the operation signal to operate each component of the printing device 1.

A device body 10 is contained inside the housing 2.

The device body 10 includes a base 11, a finger holder 6 attached to the base 11, a printing portion 40, and the like.

The printing portion 40 performs printing to the printing target surface in accordance with predetermined print data, and includes a head moving mechanism (not shown in the drawings) for moving a print head 41 that performs the printing operation and a print head unit 42 that includes the print head 41.

The head moving mechanism includes an X-direction moving motor for moving the print head 41 in the left and right direction (X direction) of the device, and a Y-direction moving motor for moving the print head 41 in the front and rear direction (Y direction) of the device. The X-direction moving motor and the Y-direction moving motor are not shown in the drawings. The head moving mechanism moves the print head 41 in the left and right direction (X direction) of the device and the front and rear direction (Y direction) of the device by the X-direction moving motor and the Y-direction moving motor driving as needed.

The print head 41 in the present embodiment applies printing to the printing target surface of the nail T which is the printing target.

As the printing target surface, in addition to the surface of nail T, a surface of gel nail may be the printing target surface when the gel nail is already applied onto the nail T, and a surface of fake nail may be the printing target surface when the fake nail is applied.

The surface of the print head 41 facing the printing target surface (surface of nail T, or the like) is the ink ejection surface that includes a plurality of nozzle openings to eject ink (none of them shown in the drawings). The print head 41 is an inkjet head of an inkjet type that performs printing by making the ink be micro droplets and directly spraying the ink to the printing target surface (surface of nail T, or the like) of the nail T which is the printing target from the ink ejection surface. Though the configuration of the print head 41 is not particularly limited, the print head 41 is a cartridge-integrated type head in which the ejecting mechanism of the ink ejection surface and the ink cartridge (neither of them shown in the drawings) are integrated, for example.

The print head 41 can eject ink of yellow (Y), magenta (M) and cyan (C), for example. The type of ink included in the print head 41 is not limited to this.

When the print head 41 perform printing by an inkjet method as in the present embodiment, the print head 41 performs printing by ejecting the ink while moving above the printing target surface (surface of nail T, or the like). When the lower surface of the print head 41 (ink ejection surface not shown in the drawings) and the printing target surface are excessively far away from each other, the ink cannot attach to the correct position and it is not possible to perform highly accurate printing.

Thus, it is preferable to adjust the distance between the print head 41 and the printing target surface (surface of nail T, or the like) at the time of printing, to be approximately several millimeters. In the present embodiment, as mentioned later, by holding a finger U (see FIGS. 6 and 7) corresponding to the nail T to be printed in the finger holder 6, the printing target surface of nail T is positioned at the position (printing position) appropriate for printing by the print head 41.

The finger holder 6 holds the finger U corresponding to the nail T which is the printing target at a printing position (position appropriate for printing). The finger holder 6 is arranged in the nearly central portion of the base 11 in the left and right direction (X direction) of the device as shown in FIG. 1, for example.

The finger holder 6 in the present embodiment can be detached from the base 11 and taken out from the printing device 1.

Figure 2:
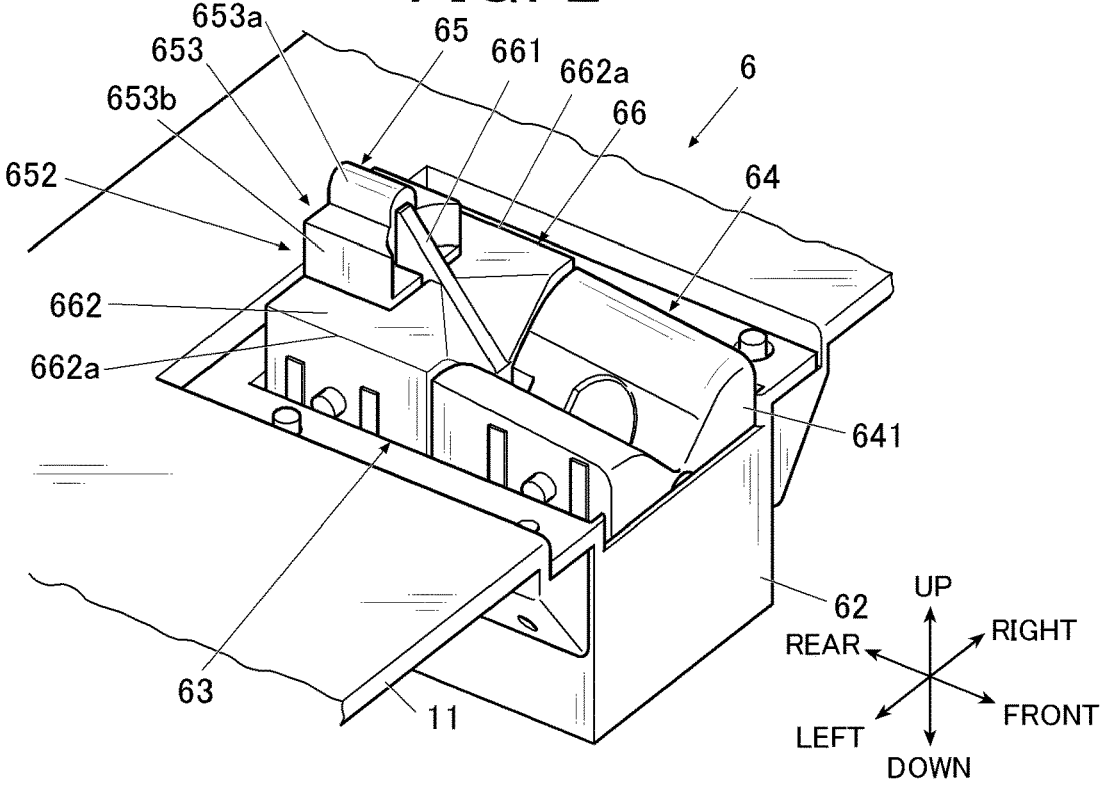
FIG. 2 is a perspective view showing the main part configuration of a finger holder in the present embodiment.
Figure 3:
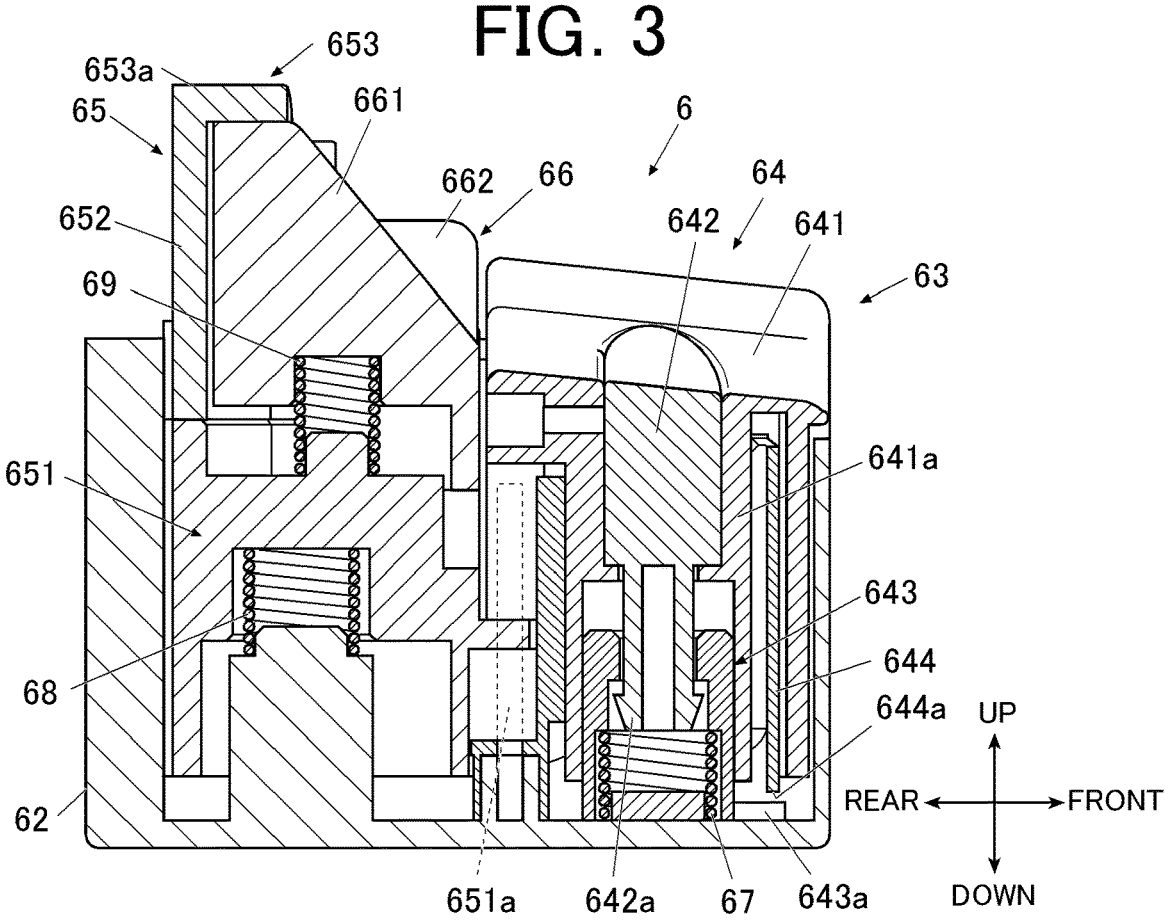
FIG. 3 is a lateral sectional view of the finger holder.
Figure 4:
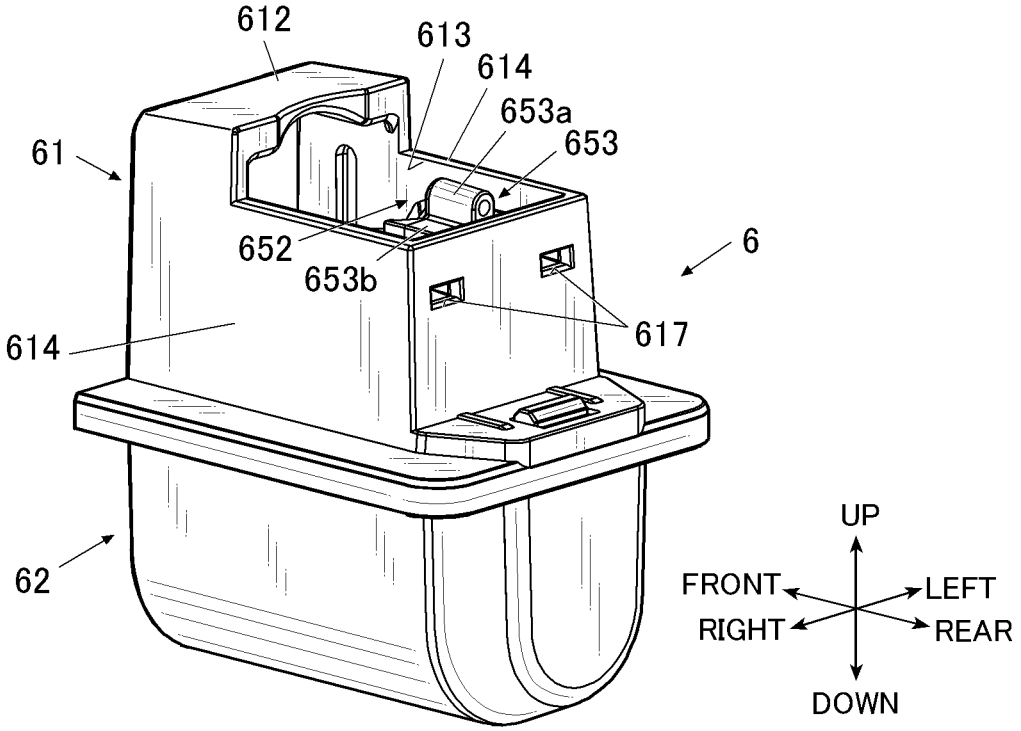
FIG. 4 is a view showing an outer appearance shape of the finger holder.

FIG. 2 is a perspective view of the finger holder, and FIG. 3 is a sectional view showing the internal configuration of the finger holder. In FIGS. 2 and 3, the illustration of the upper case is omitted. FIG. 4 is a perspective view of the outer appearance of the finger holder seen from an obliquely rear position.

As shown in FIG. 4, for example, the finger holder 6 includes an upper case 61 and a lower case 62 which are formed in a nearly box shape, and a lifting/lowering mechanism 63 which is contained inside the upper case 61 and the lower case 62.

The upper surface of the lower case 62 is open, and the upper case 61 is set to cover the opening of the upper surface of the lower case 62.

As shown in FIG. 1, the upper case 61 is formed in a U shape in a front view, and the front surface thereof is an opening 611 for inserting the finger U (see FIGS. 6 and 7) into the finger holder 6.

The front side portion of the upper surface of the upper case 61 is a finger pressing portion 612 that prevents rising of the finger U and defines the height position of the finger U. A cushioning member formed of a resin or the like may be provided to the portion of the finger pressing portion 612 contacting the upper side of the finger U.

The back side (rear side) portion of the upper surface of the upper case 61 is open, to form a window 613 that upwardly exposes the nail T of the finger U inserted into the finger holder 6.

The lifting/lowering mechanism 63 biases the finger U which is inserted into the finger holder 6 to the upward direction of the device. The lifting/lowering mechanism 63 is configured by including a plurality of lifting/lowering members which are connected to each other and arranged along the inserting direction of the finger U, and each of which can move up and down.

The lifting/lowering mechanism 63 in the present embodiment includes three lifting/lowering members that are a first lifting/lowering member 64 which is arranged on a relatively front side in the inserting direction (front and rear direction) of the finger U, a second lifting/lowering member 65 which is arranged on a relatively back side (backmost side in the present embodiment) in the inserting direction of the finger U, and a third lifting/lowering member 66 which is arranged between the first lifting/lowering member 64 and the second lifting/lowering member 65. The three lifting/lowering members are a finger fixing member that pushes up the finger U from the lower side and supports and fixes the finger U.

The first lifting/lowering member 64 includes a lifting/lowering member body 641 and a locking shaft portion 642.

The upper surface of the lifting/lowering member body 641 is an inclined surface in a nearly V shape that becomes lower toward the central portion from the both sides along the finger U inserting direction, and prevents the finger U from becoming rickety in the left and right direction when the finger U is placed.

A knock shaft portion 641*a* in a hollow cylinder form which is vertically open is provided in a hanging manner in the nearly central portion on the lower side of the lifting/lowering member body 641. The opening end on the lower side of the knock shaft portion 641*a* is the pressing portion in a serration form (not shown in the drawings).

The locking shaft portion 642 is inserted inside the knock shaft portion 641*a*, and locked in the knock shaft portion 641*a* so as not to come off in the shaft direction.

The locking tab 642*a* is provided to the lower end of the locking shaft portion 642. A cylindrical rotating member 643 which is vertically open is locked to the locking tab 642*a* of the locking shaft portion 642.

In such a way, the locking shaft portion 642 is locked to the knock shaft portion 641*a* and connected to the rotating member 643, and locks the knock shaft portion 641*a* and the rotating member 643. By locking the knock shaft portion 641*a* to the rotating member 643 via the locking shaft portion 642, when the rotating member 643 is fixed to an after-mentioned fixing member 644, the knock shaft portion 641*a* does not become free and the movement in the up and down direction is regulated.

The rotating member 643 is pressed by the pressing portion of the knock shaft portion 641*a* and rotates. To be specific, the rotating member 643 includes a plurality of locking protrusions 643*a* which are provided to protrude in the circumferential direction on the edge of the lower end. By these locking protrusions 643*a* being pressed by the pressing portions in a serration form on the lower end of the knock shaft portion 641*a*, the rotating member 643 rotates around the central axis along the up and down direction.

A step portion having a larger inner diameter on the lower side than the inner diameter on the upper side is formed inside the rotating member 643, and a first spring 67 is arranged to have the upper end thereof contacting the lower surface of the step portion. Thus, the first lifting/lowering member 64 which is locked to the rotating member 643 via the locking shaft portion 642 is biased upward by the first spring 67.

The fixing member 644 in a nearly cylindrical form is arranged on the outer circumferential side of the knock shaft portion 641*a*. The fixing member 644 is configured to be in a locking state of locking the locking protrusions 643*a* of the rotating member 643 and in a released state in which the locking is released.

The fixing member 644 is fixed to the bottom surface of the lower case 62.

A plurality of guide grooves (not shown in the drawings) extending in the up and down direction is formed on the inner circumferential surface of the fixing member 644. The guide grooves are provided to correspond to the locking protrusions 643*a* of the rotating member 643, and guide the locking protrusions 643*a* to the lower end of the fixing member 644 when the rotating member 643 is pressed down.

A plurality of cutout portions 644*a* locking the locking protrusions 643*a* is formed on the lower end of the fixing member 644. The cutout portions 644*a* correspond to the guide grooves and provided to communicate with the guide grooves.

Thus, when the locking protrusions 643*a* move to the lower end of the fixing member 644 along the guide grooves and rotate, the locking protrusions 643*a* fit in the cutout portions 644*a*, and the movement in the up and down direction of the rotating member 643 is regulated. In a state in which the rotating member 643 is fixed to the fixing member 644 in such a way, the first lifting/lowering member 64 locked to the rotating member 643 is also fixed to the fixing member 644 via the rotating member 643 and the locking shaft portion 642, and the movement in the up and down direction of the first lifting/lowering member 64 is regulated.

By the knock shaft portion 641*a* pressing down the rotating member 643, the locking protrusions 643*a* of the rotating member 643 move by being pressed by the inclined surface of the pressing portion in a serration form of the knock shaft portion 641*a*, and the locking protrusions 643*a* detach from the cutout portions 644*a* of the fixing member 644. When the locking protrusions 643*a* move to the guide grooves of the fixing member 644, the locked state of the locking protrusions 643*a* is released, and the rotating member 643 and the first lifting/lowering member 64 connected to the rotating member 643 are pushed up by the biasing force of the first spring 67.

In the present embodiment, the knock shaft portion 641*a*, the rotating member 643, and the fixing member 644 form a locking cam mechanism that can regulate the up and down movement of the first lifting/lowering member 64 and release the regulation. This mechanism is not limited to the locking cam mechanism shown in the embodiment as long as the mechanism can regulate the movement of the lifting/lowering member. The mechanism may be a heart cam mechanism, for example.

The second lifting/lowering member 65 is integrated with the third lifting/lowering member 66 in such a manner that the second lifting/lowering member 65 sandwiches the third lifting/lowering member 66 therein. To be specific, the second lifting/lowering member 65 includes a lifting/lowering member body 651 on the lower side and a connecting portion 652 on the upper side. The connecting portion 652 and the lifting/lowering member body 651 are fixed in a state in which the connecting portion 652 and the lifting/lowering member body 651 sandwich the third lifting/lowering member 66 from upper and lower sides.

The lifting/lowering member body 651 has, on the front side, a shaft portion 651*a* which is provided to stand upwardly. The shaft portion 651*a* is fit in a hole portion (not shown in the drawings) of the first lifting/lowering member 64. Thus, when the first lifting/lowering member 64 is pressed down, the position of the second lifting/lowering member 65 is also lowered.

A second spring 68 is arranged on the lower side of the lifting/lowering member body 651, and the second lifting/lowering member 65 is biased upward by the second spring 68.

The upper end of the communicating portion 652 of the second lifting/lowering member 65 is a nail rest 653 to place the nail T when the finger U is inserted into the finger holder 6.

The nearly central portion of the nail rest 653 is a nail placement portion 653*a* which is higher than the other portion. The nearly central portion of the tip of the nail T can be caught on the nail placement portion 653*a*.

The portion on both sides of the nail placement portion 653*a* and lower than the nail placement portion 653*a* is a base portion 653*b* which is formed to extend in the left and right direction (X direction) of the device. The tip of the finger U abuts against the base portion 653*b*.

The third lifting/lowering member 66 includes an inclined portion 661 which is inclined to become gradually higher from the front side toward the back side in the inserting direction of the finger U, and a lifting/lowering member body 662 which is arranged on the left and right sides of the inclined portion 661. The front side portion of the upper surface of the lifting/lowering member body 662 is inclined in a nearly V shape to become lower from the left and right sides toward the inclined portion 661.

The third spring 69 is arranged on the lower side of the third lifting/lowering member 66. The third lifting/lowering member 66 is biased upward by the third spring 69.

By having the above-described configuration, in the lifting/lowering mechanism 63, when the second lifting/lowering member 65 is pressed down, the position of the third lifting/lowering member 66 is also lowered, but the first lifting/lowering member 64 does not move. When the pressing-down force is released, the height positions of the second lifting/lowering member 65 and the third lifting/lowering member 66 return upwardly by the biasing forces of the second spring 68 and the third spring 69.

When the third lifting/lowering member 66 is pressed down, the position of the second lifting/lowering member 65 is also lowered by the third spring 69, but the first lifting/lowering member 64 does not move. When the pressing-down force is released, the height positions of the second lifting/lowering member 65 and the third lifting/lowering member 66 return upwardly by the biasing forces of the second spring 68 and the third spring 69.

On the other hand, when the first lifting/lowering member is pressed down, the second lifting/lowering member 65 connected to the first lifting/lowering member 64 is also pressed down, and in accordance with this, the position of the third lifting/lowering member 66 is also lowered.

When the first lifting/lowering member 64 is pressed down to be equal to or lower than a predetermined height from the state in which the first lifting/lowering member 64, the second lifting/lowering member 65, and the third lifting/lowering member 66 are raised to be high, the upward movement of the first lifting/lowering member 64 is regulated by the above-mentioned locking cam mechanism. Thus, the state in which the first lifting/lowering member 64, the second lifting/lowering member 65, and the third lifting/lowering member 66 are pressed down is held. This lowered state is made for facilitating the insertion and removal of the finger U into and from the finger holder 6.

When the first lifting/lowering member 64 is pressed down to be equal to or lower than a predetermined height from this lowered state, the regulation of the upward movement of the first lifting/lowering member 64 is released by the above-mentioned locking cam mechanism. Thus, the first lifting/lowering member 64, the second lifting/lowering member 65, and the third lifting/lowering member 66 rise, returning to the state in which the lifting/lowering mechanism 63 is raised.

At this time, when the finger U is inserted into the finger holder 6 and placed on the first lifting/lowering member 64, the second lifting/lowering member 65, and the third lifting/lowering member 66, the finger U is sandwiched between the lifting/lowering members of the lifting/lowering mechanism 63 and the finger pressing portion 612, and fixed to such a degree that the free movement during printing is regulated. In this state, the tip of the finger U abuts against the base portion 653*b*, and the tip of the nail T is caught on the upper end of the nail placement portion 653*a* to be placed.

Thus, the finger U is fixed at the position where printing can be appropriately performed to the nail T, and the surface of nail T or the like which is the printing target surface is positioned at the position appropriate for printing by the print head 41 (that is, the height position which has the distance from the lower surface of the print head 41 of approximately several millimeters, printing position).

In the present embodiment, there is also provided a nail height adjusting member 7 (spacer or shim) which is formed to be attachable to and detachable from the finger holder 6.

The nail height adjusting member 7 is an adjusting device that presses down the nail rest 653 of the finger holder 6 against the biasing forces of the second spring 68 and the third spring 69 which are the biasing members.

Figure 5:
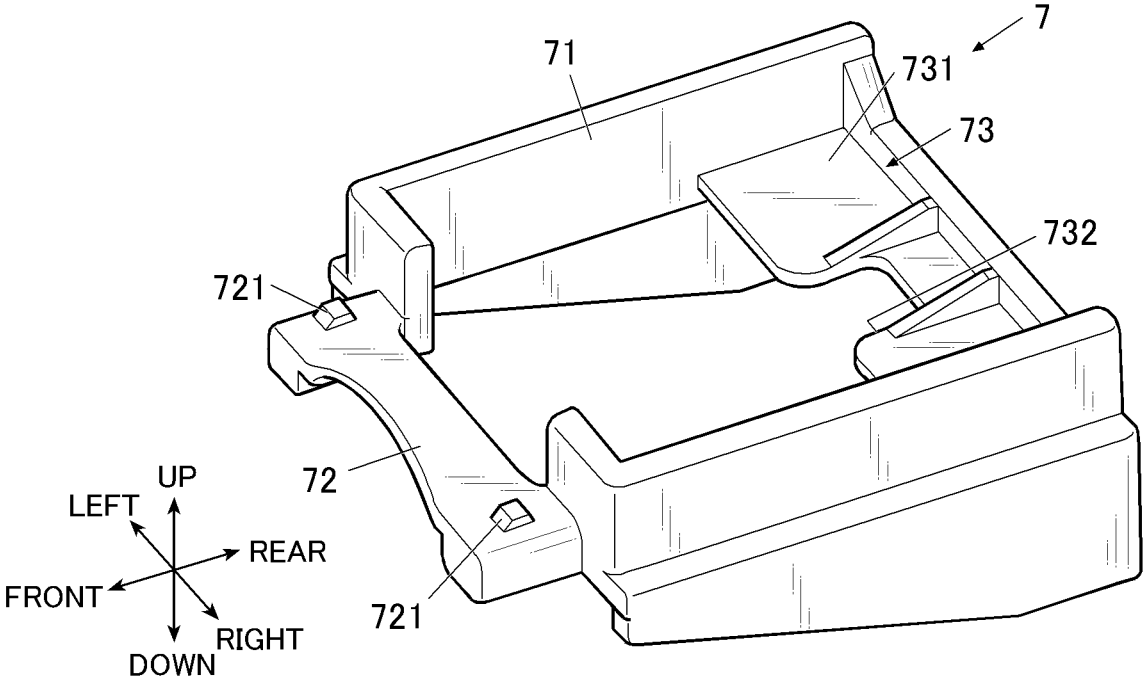
FIG. 5 is a perspective view of a nail height adjusting member in the present embodiment.

FIG. 5 is a perspective view of the nail height adjusting member 7 seen from an obliquely upward direction.

As shown in FIG. 5, the nail height adjusting member 7 in the present embodiment has a frame body 71 which opens in the up and down direction (up and down direction in FIG. 5, for example).

The opening on the lower side of the frame body 71 is formed to have a width and a length which are slightly larger than those of the window 613 of the upper case 61, and can be fit to the upper portion of the upper case 61 so as to cover the peripheral edge of the window 613.

On the outer surface on the front side of the frame body 71, there is provided an extending portion 72 which is located on the lower side of the finger pressing portion 612 of the upper case 61 when the frame body 71 is placed (fit) over the upper case 61.

Recesses not shown in the drawings are formed on the lower surface of the finger pressing portion 612, and first locking protrusions 721 are formed at the positions corresponding to the recesses on the upper surface of the extending portion 72.

As shown in FIG. 4, locking portions 617 which are recesses or holes are formed on the rear end surface of the upper case 61 in the present embodiment. On the inner surface on the rear back of the frame body 71, there are provided second locking protrusions (not shown in the drawings) which are locked to the locking portions 617 of the upper case 61 when the frame body 71 is placed (fit) over the upper case 61.

A plate-like pressing portion 73 formed to extend inside the frame body 71 is provided on the rear end surface of the frame body 71.

A cutout portion 732 which is cut out to surround the nail placement portion 653*a* is formed at a position in the nearly central portion of the pressing portion 73, the position corresponding to the position of the nail placement portion 653*a* when the frame body 71 is placed (fit) over the upper case 61.

On both sides of the cutout portion 732 in the pressing portion 73, there are provided position regulating portions 731 which contact the upper surfaces of the base portion 653*b* and regulate the height position of the base portion 653*b* when the frame body 71 is placed (fit) over the upper case 61.

In the present embodiment, when the nail height adjusting member 7 is attached to the finger holder 6 so as to place (fit) the frame body 71 over the upper case 61, the pressing portion 73 contacts the upper surface of the base portion 653*b* of the nail rest 653 and presses down the base portion 653*b*, and the height of the nail rest 653 including the nail placement portion 653*a* is lowered.

The shape, configuration and the like of the nail height adjusting member 7 are not limited to the illustrated example which has been described.

The specific shape and the like of the nail height adjusting member 7 can be appropriately changed as long as the nail height adjusting member 7 is configured to be attachable to and detachable from the finger holder 6, and can press down the nail rest 653 against the biasing forces of the second spring 68 and the third spring 69 which are the biasing members when the nail height adjusting member 7 is attached to the finger holder 6.

Next, the action of the printing device in the present embodiment will be described with reference to FIGS. 6 and 7.

Figure 6:
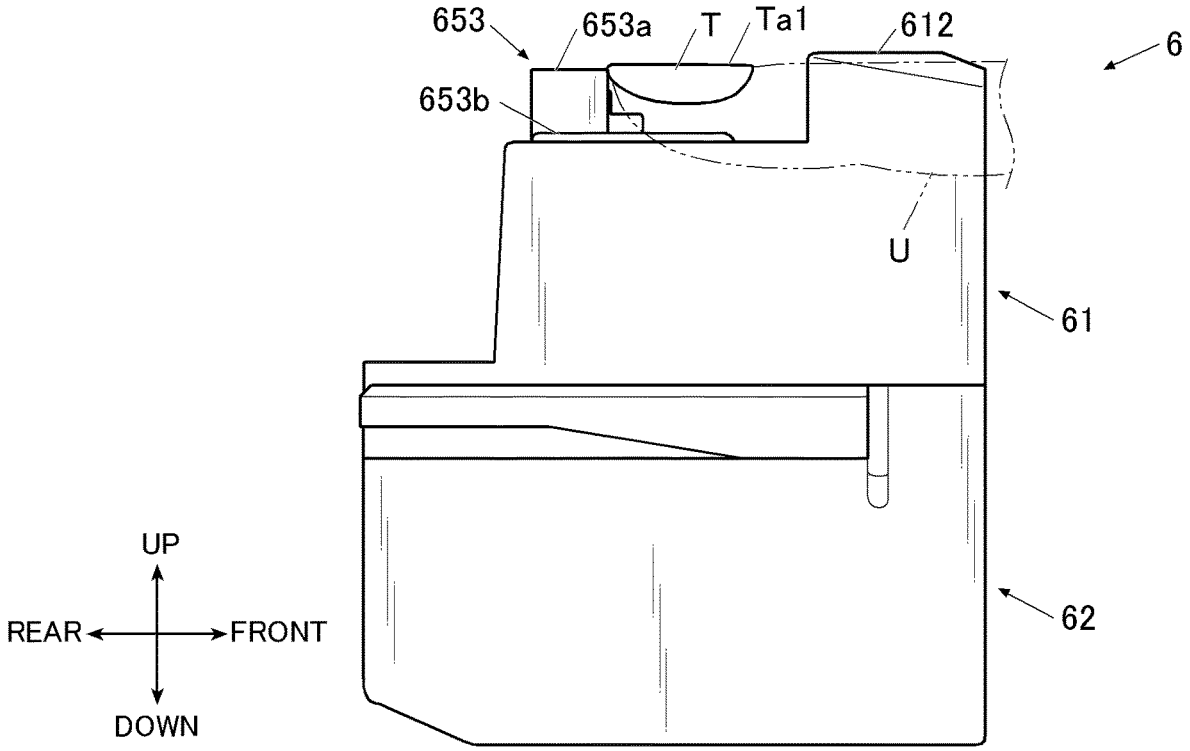
FIG. 6 is a lateral view showing the state in which the nail height adjusting member is not attached to the finger holder.

When printing is performed by using the above printing device 1 to the normal nail T which is not processed at all, as shown in FIG. 6, the user inserts the finger U into the finger holder 6 to which nothing is attached. The "nail T which is not processed at all" is not limited to nails which are not painted at all. The "nail T which is not processed at all" in the embodiment includes nails to which the ground, coating and/or the like is applied.

At this time, the user makes the tip of the finger U abut against the base portion 653*b* of the nail rest 653, and inserts the finger U to the position where the tip of the nail T is placed on the nail placement portion 653*a*, the first lifting/lowering member 64, the second lifting/lowering member 65, and the third lifting/lowering member 66 are in the raised state and the lifting/lowering mechanism 63 is in the raised state.

Thus, the finger U is sandwiched between the lifting/lowering members of the lifting/lowering mechanism 63 and the finger pressing portion 612 and fixed to such a degree that the free movement during printing is regulated. In this state, the finger U is fixed at the position where printing can be appropriately performed to the nail T, and the surface Ta1 of the nail T which is the printing target surface is positioned at the position appropriate for printing by the print head 41 (that is, the height position which has the distance from the lower surface of the print head 41 of approximately several millimeters, printing position).

Figure 7:
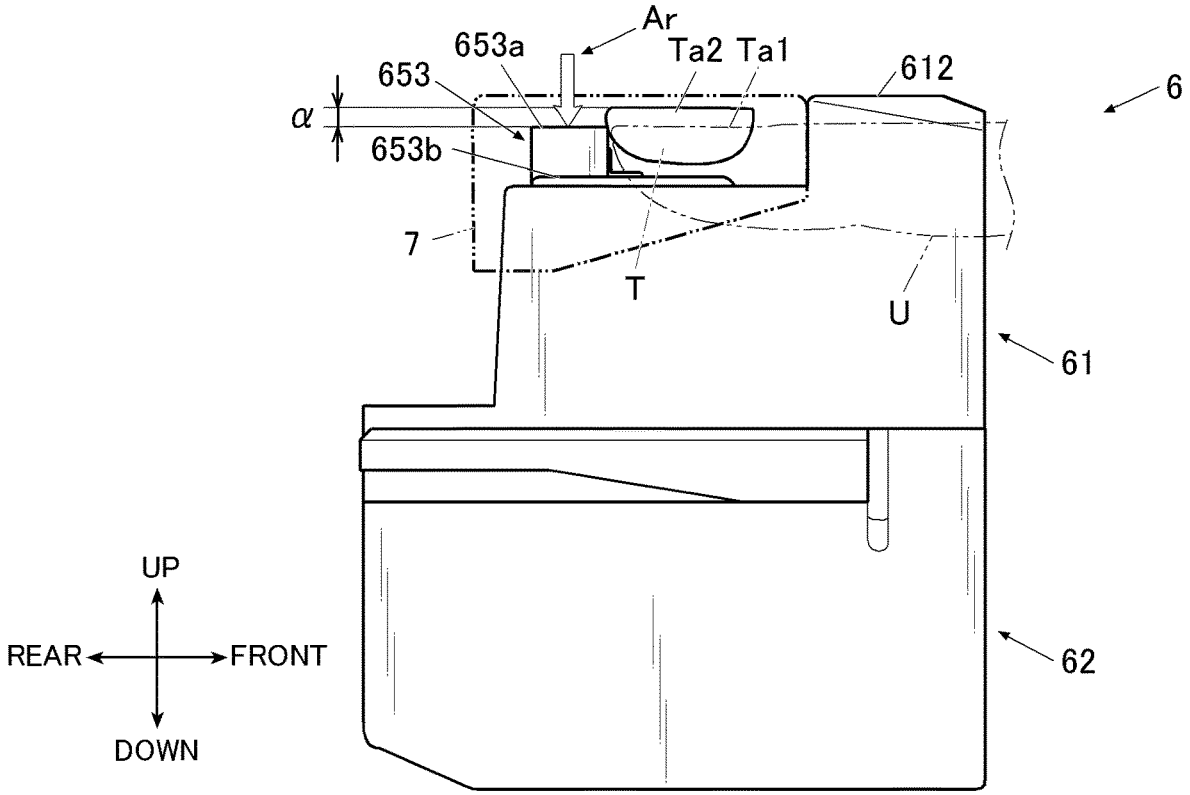
FIG. 7 is a lateral view showing the state in which the nail height adjusting member is attached to the finger holder.

On the other hand, when printing is performed to the nail T which is processed, as shown in FIG. 7, the user attaches the nail height adjusting member 7 to the finger holder 6, and inserts the finger U into the finger holder 6 to which the nail height adjusting member 7 is attached.

To be specific, as the nail T which is processed, when the nail T is higher (rises) by 1 to 2 millimeters than the surface Ta1 of the nail T which is not processed at all, for example, when a gel nail is already applied to the nail T to be printed or when a fake nail is attached to the nail T, the nail height adjusting member 7 is attached to the finger holder 6 to be used.

To attach the nail height adjusting member 7 to the finger holder 6, the finger holder 6 is detached from the base 11 and taken out from the printing device 1.

The frame body 71 fits on the upper portion of the upper case 61, and the first locking protrusions 721 fit into the recesses on the lower side of the finger pressing portion 612 such that the extending portion 72 is arranged on the lower side of the finger pressing portion 612.

The second locking protrusions formed on the rear end surface of the frame body 71 are locked to the locking portions 617 formed on the rear end surface of the upper case 61 of the finger holder 6.

Thereby, the nail height adjusting member 7 is attached to the finger holder 6.

In this state, the position regulating portions 731 of the pressing portion 73 contact the upper surfaces of the base portion 653*b* of the nail rest 653, and presses down the base portion 653*b* against the biasing forces of the second spring 68 and the third spring 69 which are the biasing members.

Thus, the height position of the entire nail rest 653 is pressed down according to the height position of the position regulating portions 731 of the pressing portion 73.

FIG. 7 shows a state in which the nail height adjusting member 7 is attached to the finger holder 6.

In FIG. 7, the surface (printing target surface) of "nail T which is not processed at all" is referred to as Ta1, the surface (printing target surface) of "nail T which is processed) is referred to as Ta2, and the difference between these heights of the printing target surface (difference between the thicknesses of nail T caused by the process) is referred to as "α".

The position regulating portions 731 of the nail height adjusting member 7 press down the height of the nail rest 653 by the amount of "α" in the direction shown by the arrow Ar. By attaching the nail height adjusting member 7 to the finger holder 6, the height position of the surface Ta1 of the nail T in FIG. 6 and the height position of the surface Ta2 of the nail T in FIG. 7 become nearly equal to each other.

The height position of the position regulating portions 731 is designed in advance according to the height to press down the nail rest 653.

For example, when a general gel nail is applied to the nail T or a fake nail is attached to the nail T and the increased amount of thickness of the nail T is approximately 1 mm, the position regulating portions 731 regulate the position of the upper surfaces of the base portion 653*b* at the height position which is lower by approximately 1 mm than the height position of the upper surface of the base portion 653*b* when the nail rest 653 is held by the biasing forces of the second spring 68 and the third spring 69 which are the biasing members.

Thereby, the height position of the entire nail rest 653 is pressed down by approximately 1 mm.

It is preferable that the thickness of the extending portion 72, which is positioned on the lower side of the finger pressing portion 612 when the nail height adjusting member 7 is attached, is nearly same as the amount of thickness difference "α" (for example, approximately 1 mm in the above example) which is pressed down by the position regulating portions 731.

By making the thickness of the extending portion 72 be nearly equal to the amount of thickness difference "α", the height of the upper surface of the finger U pressed by the finger pressing portion 612 is lowered equally when the height of the nail rest 653 is lowered and the position of the surface of the nail T is lowered. Thus, it is possible to avoid a situation that only the nail T is lowered unnaturally, and the abutting of the upper surface of the finger U is weakened and becomes unstable.

When the attaching of the nail height adjusting member 7 is completed, the finger holder 6 is set to the base 11 again and the finger U is inserted.

At this time, similarly to printing to the nail T "which is not processed at all", the tip of the finger U abuts against the base portion 653*b* of the nail rest 653, the finger U is inserted to such a position that the tip of the nail T is placed on the nail placement portion 653*a*, the first lifting/lowering member 64, the second lifting/lowering member 65, and the third lifting/lowering member 66 are in the raised state, and the lifting/lowering mechanism 63 is in the raised state.

Thus, the finger U is sandwiched between the lifting/lowering members of the lifting/lowering mechanism 63 and the finger pressing portion 612 and fixed to such a degree that the free movement during printing is regulated. In this state, the finger U is fixed at the position where printing can be appropriately performed to the nail T, and the surface Ta2 (surface of a gel nail or a fake nail, for example) of the nail T which is the printing target surface is positioned at the position appropriate for printing by the print head 41 (that is, the height position which has the distance from the lower surface of the print head 41 of approximately several millimeters).

When the thickness of nail T is normal, printing is performed without attaching the nail height adjusting member 7 to the finger holder 6. When the thickness of nail T is thicker than usual, printing is performed in a state in which the nail height adjusting member 7 is attached to the finger holder 6. In such a way, by attaching or detaching the nail height adjusting member 7 as needed according to the thickness of nail T, it is possible to perform printing at the height position appropriate for printing regardless of the thickness of nail T.

As described above, the printing device 1 in the present embodiment includes: a print head 41 that performs printing to a printing target surface Ta1, Ta2 of the nail T which is the printing target; a finger holder 6 that includes a nail rest 653 that includes a nail placement portion 653*a* on which the nail T is placed, and biasing members 68 and 69 that bias the nail rest 653 in the direction of pushing up the nail rest 653 to locate the printing target surface Ta1, Ta2 of the nail T placed on the nail rest 653 at the position appropriate for printing by the print head 41; and a nail height adjusting member 7 that presses down the nail rest 653 against the biasing forces of the biasing members 68 and 69.

Thus, it is possible to perform printing at the position appropriate for printing having a constant distance from the print head 41, to not only the surface of nail T (printing target surface Ta1) in a normal state, but also the surface of nail T (printing target surface Ta2) having the thickness increased due to the gel nail, fake nail or the like.

Thus, even when the thickness of nail T is increased, it is possible to avoid the risk of contact between the print head 41 and the surface of nail T (printing target surface Ta1, Ta2).

The distance between the print head 41 and the surface of nail T (printing target surface Ta1, Ta2) can be maintained nearly constant regardless of the thickness of nail T. Thus, it is possible to perform printing with a beautiful finish which has no disrupted ink application.

As in the present embodiment, the nail height adjusting member 7 is configured to be attachable to and detachable from the finger holder 6.

Thus, it is possible to handle nails flexibly by removing the nail height adjusting member 7 from the finger holder 6 when printing is performed to the surface of nail T (printing target surface Ta1) in a normal state, and by attaching the nail height adjusting member 7 to the finger holder 6 when printing is performed to the surface of nail T (printing target surface Ta2) having the thickness increased due to the gel nail, fake nail or the like.

In such a way, since nails T having different thicknesses are handled by attaching or detaching the nail height adjusting member 7 as the attachment, it is possible to easily perform appropriate printing corresponding to nails T of various thicknesses without complicating the configuration of the finger holder 6 itself.

Though the embodiment of the present invention has been described above, the present invention is not limited to the embodiment, and various modifications can be made within the scope of the present invention.

Figure 8:
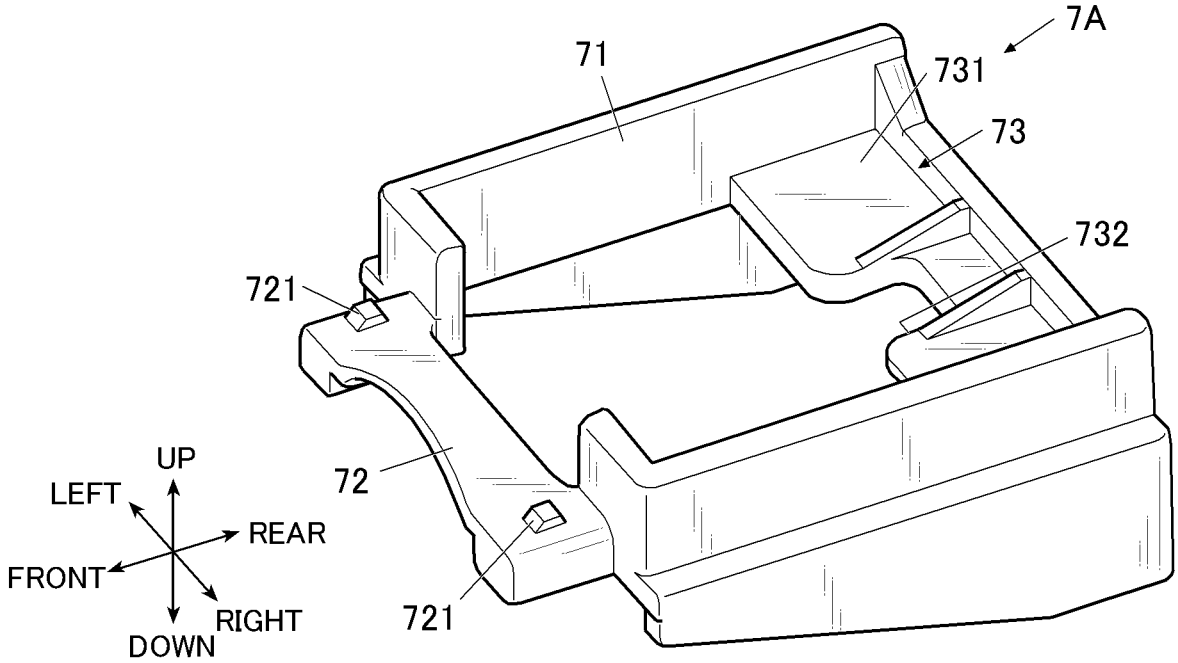
FIG. 8 is a perspective view of a nail height adjusting member in a modification example.

For example, though the embodiment takes, as an example, the configuration of preparing a single type of nail height adjusting member 7, as shown in FIG. 8, a plurality of types of nail height adjusting members 7A having thicknesses of the position regulating portion 731 different from the thickness of the position regulating portion 731 in the nail height adjusting member 7 may be prepared according to the thicknesses of nails T to be placed on the nail placement portion 653*b*.

In this configuration, it is possible to widely handle nails T to which various types of processes were performed with a simple configuration by a single printing device 1.

The nail height adjusting member 7 may be configured to adjust the height position of the nail placement portion 653*a* at a plurality of steps according to the thickness of nail T to be placed on the nail placement portion 653*b*.

Figure 9:
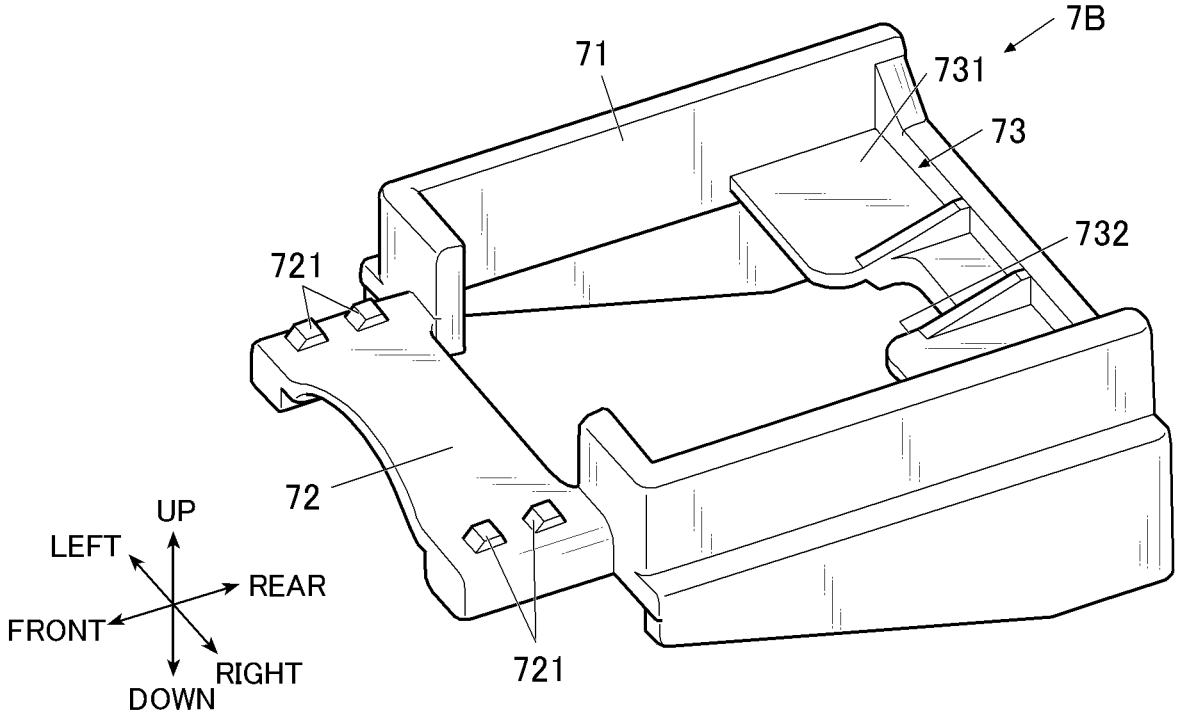
FIG. 9 is a perspective view of a nail height adjusting member in a modification example.

For example, as shown in FIG. 9, in order to enable the nail height adjusting member 7B having the thickness of position regulating portion 731 varying in the front and back direction to hold the base portion 653*b* at a plurality of height positions, the locking protrusions 721 for locking the nail height adjusting member 7B to the finger holder 6 may be provided at multiple steps in the front and rear direction of the nail height adjusting member 7B. By a single nail height adjusting member 7B, it is possible to widely handle nails T to which various types of processes were performed.

The present embodiment has been described by taking, as an example, the configuration in which the finger holder 6 is attachable to and detachable from the base 11. However, it is not essential that the finger holder 6 is attachable and detachable.

For example, when the portion covering the upper portion on the front surface side of the device in the housing 2 is configured to be openable/closable via a hinge structure or the like, in a state in which the portion covering the upper portion on the front surface side of the device in the housing 2 is open, the nail height adjusting member 7 may be attached and detached in a state in which the finger holder 6 is mounted. This configuration can be a configuration in which the finger holder 6 is fixed to the base 11.

The configuration of lifting/lowering mechanism 63 is not limited to the above-described example.

The present embodiment has been described by taking, as an example, the configuration in which the finger holder 6 is formed of three members, biasing members (for example, springs) corresponding to the respective members are provided, and the lifting/lowering mechanism 63 is formed of three or more biasing members. However, when the finger holder 6 is a single member, the lifting/lowering mechanism 63 may be formed of a single biasing member. The number of members forming the finger holder 6 may not match the number of biasing members forming the lifting/lowering mechanism 63. For example, even when the finger holder 6 is formed of three or more members, the lifting/lowering mechanism 63 may be formed of a single biasing member.

The configuration for lifting and lowering the lifting/lowering mechanism 63 is not limited to the configuration shown in the present embodiment.

For example, the lifting/lowering mechanism 63 may not use the springs or the like, but expansion and contraction of air, liquid, or the like may be performed to bias the nail placement portion and locate the printing target surface at a position appropriate for printing.

Although some embodiments of the present invention have been described, the scope of the present invention is not limited to the above-mentioned embodiments. The scope of the present invention includes the scope of the present invention described in the scope of claims and the equivalents thereof.

What is claimed is:

1. A printing device comprising:

a print head;

a finger holder that includes a nail rest on which a nail is placed, and a spring which biases the nail rest in a direction of pushing up the nail rest to locate a printing target surface of the nail placed on the nail rest at a printing position by the print head; and a spacer that presses down the nail rest against a biasing force of the spring, wherein the spacer is a plurality of spacers corresponding to thicknesses of nails to be placed on the nail rest.

2. The printing device according to claim 1, wherein the spacer is attachable to and detachable from the finger holder.

3. The printing device according to claim 1, wherein the spacer is able to adjust a height position of the nail rest at a plurality of steps according to a thickness of the nail that is placed on the nail rest.

4. The printing device according to claim 1, wherein the finger holder is attachable to and detachable from the printing device.

5. A spacer that is attachable to and detachable from a finger holder and adjusts a height of a printing target surface by pressing down a nail rest against a biasing force of a spring that biases the nail rest in a direction of pushing up the nail rest, wherein the spacer is a plurality of spacers corresponding to thicknesses of nails to be placed on the nail rest.

6. An adjustment method of adjusting a height of a printing target surface, the method comprising pressing down a nail rest against a biasing force of a spring which biases the nail rest in a direction of pushing up the nail rest by using a spacer that is attachable to and detachable from a finger holder, wherein the spacer is a plurality of spacers corresponding to thicknesses of nails to be placed on the nail rest.

* * * * *